United States Patent [19]

Zitt

[11] Patent Number: 4,669,587

[45] Date of Patent: Jun. 2, 1987

[54] PORTABLE RECEPTACLE

[75] Inventor: Volker Zitt, Frankenthal, Fed. Rep. of Germany

[73] Assignee: Zika-Plastik GmbH, Frankenthal, Fed. Rep. of Germany

[21] Appl. No.: 843,783

[22] Filed: Mar. 25, 1986

[51] Int. Cl.[4] ..... A45C 3/00; A45C 5/02; A45C 5/12; A45C 13/36

[52] U.S. Cl. ..... 190/109; 190/18 R; 190/37; 206/45.34; 220/82 R; 383/106

[58] Field of Search ..... 190/100, 109, 111, 125, 190/37, 18 R, 112, 110; 383/106; 220/82 R; 312/244; 108/44; 150/52 B, 103, 117; 206/45.34, 224, 575

[56] References Cited

U.S. PATENT DOCUMENTS

| | | | |
|---|---|---|---|
| 123,708 | 2/1872 | Kinne | 190/37 |
| 146,955 | 1/1874 | Sofield | 190/37 |
| 208,398 | 9/1878 | Kast | 190/37 |
| 427,090 | 5/1890 | Lagowitz | 190/109 |
| 1,579,668 | 4/1926 | Spelrein | 190/125 |
| 1,701,953 | 2/1929 | Lowe | 190/18 R |
| 3,151,649 | 10/1964 | Mitchell | 383/106 X |
| 3,370,629 | 2/1968 | Neuman | 383/106 X |
| 3,399,009 | 8/1968 | Slade | 312/244 |
| 3,623,580 | 11/1971 | Toller | 190/125 X |
| 3,807,537 | 4/1974 | O'Reilly | 383/106 X |
| 4,002,233 | 1/1977 | Page, Jr. | 206/45.34 |
| 4,022,261 | 5/1977 | Russell | 383/106 X |
| 4,243,340 | 1/1981 | MacGregor | 190/109 X |
| 4,309,784 | 1/1982 | Cohen | 206/45.34 X |

FOREIGN PATENT DOCUMENTS

| | | | |
|---|---|---|---|
| 2220071 | 11/1973 | Fed. Rep. of Germany | 190/100 |
| 2816095 | 10/1979 | Fed. Rep. of Germany | 190/100 |
| 8300659 | 1/1983 | Fed. Rep. of Germany | . |

*Primary Examiner*—William Price
*Assistant Examiner*—Sue A. Weaver
*Attorney, Agent, or Firm*—Peter K. Kontler

[57] ABSTRACT

A portable suitcase-like receptacle has two tray-shaped sections which are pivotally connected to each other and whose bottom walls are in the form of light-transmitting panels each of which has an outer portion welded to the sidewalls and two inner portions. One inner portion defines with the outer portion a pocket, and the other inner portion has a flap which can overlie or can be inserted into the pocket.

15 Claims, 6 Drawing Figures

FIG. 1
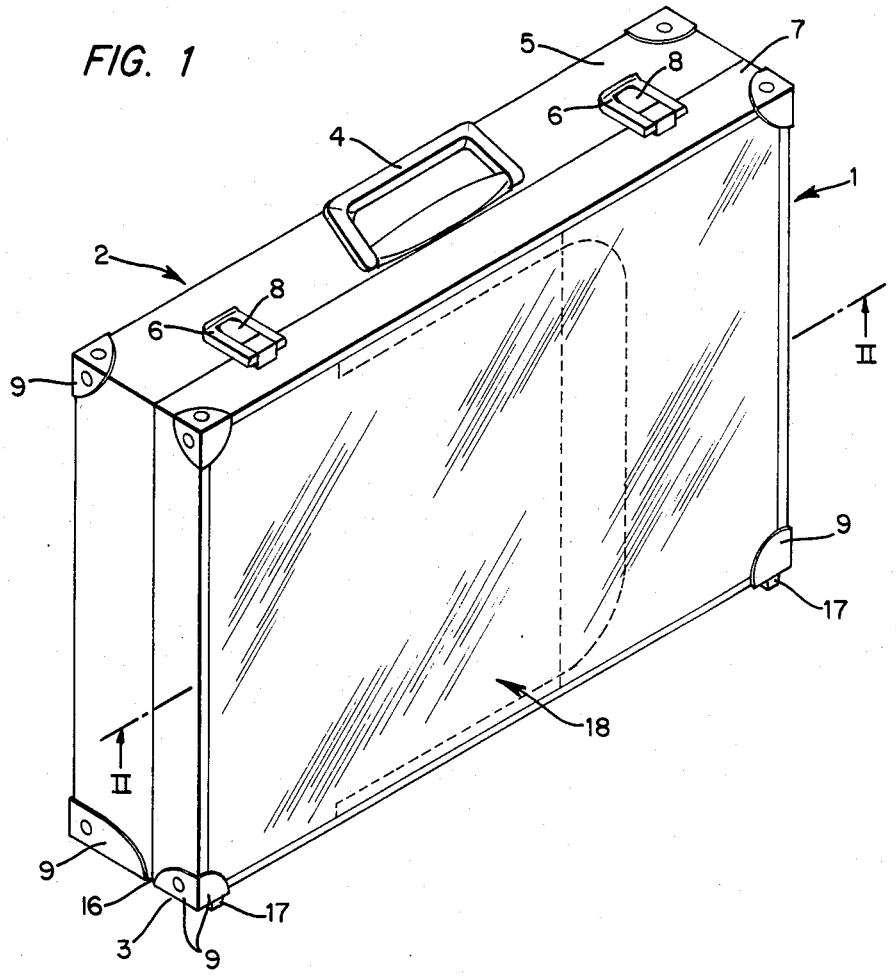
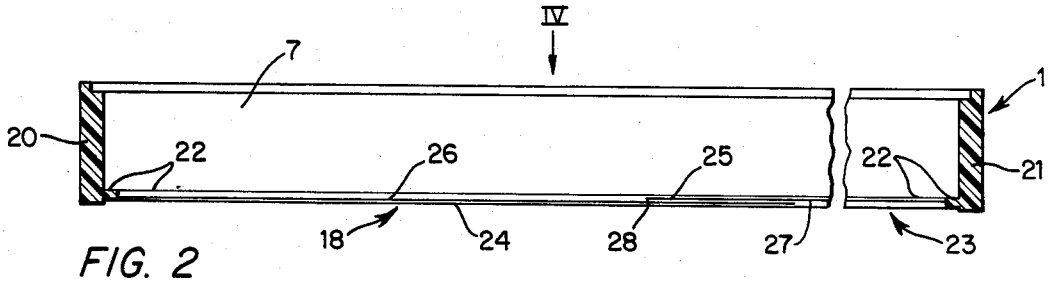
FIG. 2
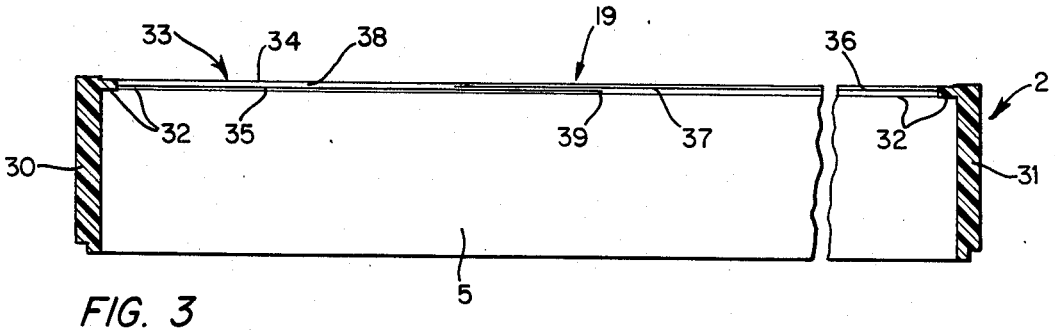
FIG. 3

PORTABLE RECEPTACLE

BACKGROUND OF THE INVENTION

The present invention relates to portable receptacles in general, and more particularly to improvements in receptacles which constitute or resemble suitcases. Still more particularly, the invention relates to improvements in receptacles of the type disclosed in commonly owned German Utility Model No. G 83 00 659.1 published Dec. 1, 1983.

The Utility Model discloses a receptacle wherein the bottom walls of the two pivotally connected tray-shaped sections are welded to ledges extending inwardly from the synthetic plastic sidewalls of the respective sections.

OBJECTS AND SUMMARY OF THE INVENTION

An object of the invention is to provide a suitcase-like receptacle whose contents can be inspected from the outside and wherein the space for confinement of goods can be used with utmost economy.

Another object of the invention is to provide a receptacle which is of eye-pleasing appearance and is capable of storing a large quantity of different goods in a small area.

A further object of the invention is to provide a receptacle wherein different types of confined goods can be separated from each other in a novel and improved way.

An additional object of the invention is to provide novel and improved bottom walls for the sections of a suitcase-like receptacle.

Still another object of the invention is to provide a receptacle which can be used as a toy as well as a portable container by children, adolescents or adults.

A further object of the invention is to provide a novel and improved suitcase-like portable receptacle which is particularly suited for use by children or adolescents as a lunch box and/or as a depository for books, pads, brochures or the like.

Another object of the invention is to provide novel and improved hinges for use in the above outlined receptacle.

An additional object of the invention is to provide a novel and improved method of subdividing the internal space of a suitcase-like receptacle.

The invention is embodied in a receptacle, particularly in a suitcase-like receptacle, which comprises a pair of substantially tray-shaped sections each including a bottom wall having marginal portions and a plurality of sidewalls extending from the marginal portions and beyond one side of the respective bottom wall. The receptacle further comprises at least one hinge which connects one sidewall of one of the sections with the adjacent sidewall of the other section. At least one of the bottom walls transmits light and includes a panel having an outer portion and at least one inner portion. The two portions of the panel define a pocket at the one side of the respective bottom wall. The pocket has an open end, and the panel can further include an at least partially flexible second inner portion which overlies the open end of the pocket. The second portion can include a flexible flap which is insertable into the pocket. The outer panel is or can be rectangular, and the two inner portions preferably extend toward each other from opposite longitudinal ends of the outer panel. The entire panel is or can be flexible.

The marginal portions of the bottom walls are or can be bonded (e.g., welded) to the respective sidewalls.

It is presently preferred to provide each section with a bottom wall which includes a light-transmitting panel and is provided with at least one pocket.

The hinge can include a first leaf which is riveted or otherwise secured to one sidewall of one of the sections, a second leaf which is riveted or otherwise secured to one sidewall of the other section, and an intermediate portion which is flexible and is disposed between and is preferably integral with the two leaves and defines a pivot axis about which the two preferably mirror symmetrical sections of the receptacle are pivotable to and from closed positions in which the two bottom walls are or can be substantially parallel to each other.

At least some of the sidewalls forming part of one section and/or the other section of the receptacle can be made of an opaque material, e.g., a hardenable synthetic plastic material.

It is also possible to configurate and install the panel of the one and/or the other bottom wall in such a way that the open end of the pocket extends between the two shorter edges of a rectangular outer portion.

The novel features which are considered as characteristic of the invention are set forth in particular in the appended claims. The improved receptacle itself, however, both as to its construction and the mode of assembling the same, together with additional features and advantages thereof, will be best understood upon perusal of the following detailed description of certain specific embodiments with reference to the accompanying drawing.

BRIEF DESCRIPTION OF THE DRAWING

FIG. 1 is a perspective view of a receptacle which embodies one form of the present invention;

FIG. 2 is a sectional view of one of the sections as seen in the direction of arrows from the line II—II of FIG. 1;

FIG. 3 is a similar sectional view of the other section;

DESCRIPTION OF THE PREFERRED EMBODIMENTS

Figure 5:
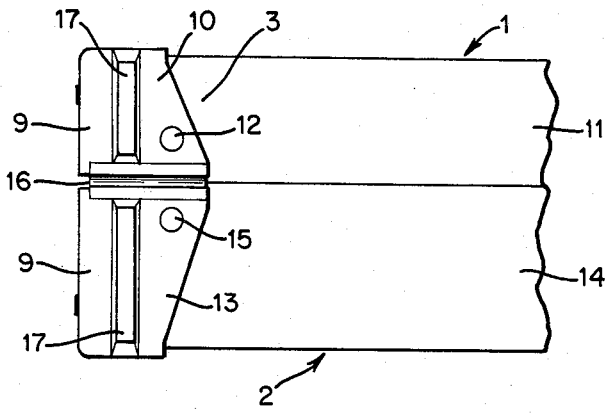
FIG. 5 is a plan view of a hinge in the receptacle of FIG. 1.

FIG. 1 shows a suitcase-like portable receptacle which comprises a shallower tray-like rectangular first section 1, a deeper tray-like rectangular second section 2, and two hinges 3 (one shown in detail in FIG. 5) which connect the sections 1 and 2 to each other in such a way that the sections can be pivoted to and from the closed positions of FIG. 1. Save for the differences in their depth, the sections 1 and 2 are or can be mirror symmetrical to each other. It is also within the purview of the invention to assemble the receptacle of two identical sections; this reduces the manufacturing cost.

The receptacle further comprises a handle 4 which is pivotally secured to one longer sidewall 5 of the section 2, two pivotable eyelets 6 mounted on one longer sidewall 7 of the section 1 and cooperating with complementary detent members 8 on the sidewall 5 to releasably hold the sections 1 and 2 in closed positions, and suitable reinforcing elements 9 for the corners of the sections. Locks may but need not be provided for the eyelets 6.

Each of the two hinges 3 comprises a first leaf 10 which is secured to the other longer sidewall 11 of the section 1 by one or more rivets 12, a second leaf 13 which is secured to the other longer sidewall 14 of the section 2 by one or more rivets 15, and a flexible intermediate portion 16 which defines a pivot axis for movements of the sections 1 and 2 to and from their closed positions. The leaves 10 and 13 have reinforcing ribs 17 which contact the floor or any other support for the receptacle when the latter is not held by hand or does not lie on the bottom wall 18 of the section 1 or on the bottom wall 19 (FIG. 3) of the section 2. The leaves 10 and 13 are preferably integral with the adjacent reinforcing elements 9. Each hinge 3 can be made of a single piece of suitably shaped synthetic plastic material.

Figure 4:
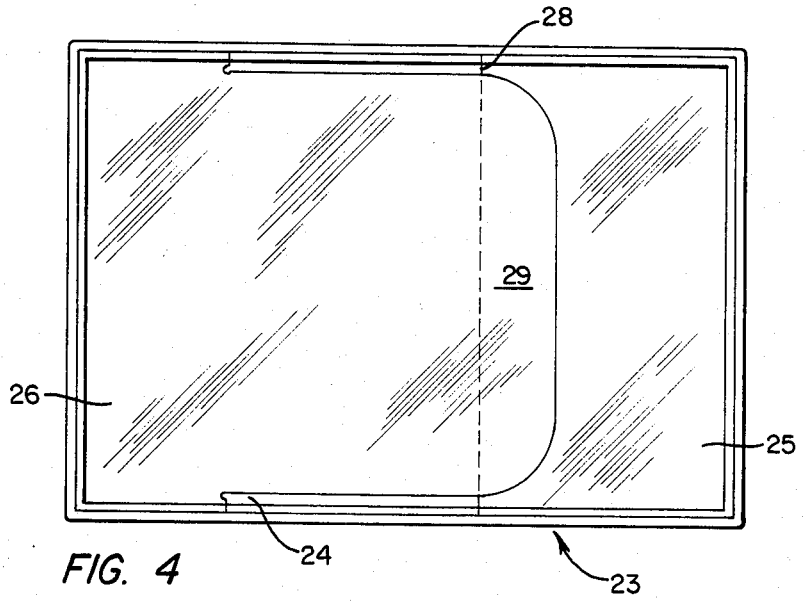
FIG. 4 is a plan view of the bottom wall of the one section as seen in the direction of arrow IV in FIG. 2.

The section 1 further comprises two shorter sidewalls 20 and 21 (see particularly FIG. 2). All four sidewalls 7, 11, 20 and 21 of the section 1 extend from one side of the bottom wall 18 and are adjacent to the respective marginal portions of such bottom wall. Furthermore, each of the sidewalls 7, 11, 20 and 21 has a narrow inwardly extending ledge 22 which is overlapped by and bonded to the respective marginal portion of the bottom wall 18. In accordance with a feature of the invention, the bottom wall 18 includes a light-transmitting flexible panel 23 of suitable synthetic plastic material, and such panel includes an elongated rectangular outer portion 24, a smaller rectangular first inner portion 25 and a larger rectangular or substantially rectangular inner portion 26. The portions 24 and 25 define a pocket 27 whose open end 28 extends transversely of the outer portion 24. The inner portion 26 has a tapering flexible flap 29 which can overlie the open end of the pocket 27 (see FIG. 4) or can extend into the pocket (see FIG. 2). The edges of the outer portion 24 and inner portion 25 are welded or otherwise bonded to the respective ledges 22, the same as the edges of that part of the second inner portion 26 whose width matches the width of the inner portion 25. It will be seen that the portions 25 and 26 extend toward each other from opposite longitudinal ends of the outer portion 24.

If the improved receptacle is used by a pupil as a combined lunch box and depository for books, pads and the like, the books and/or pads can be placed into the pocket 27 and the food is stored in the major part of the internal space of the receptacle. The receptacle can also be used by children as a toy, e.g., as a depository for garments, bottles, pacifiers and other paraphernalia which are used in connection with a doll. Of course, the receptacle is also capable of many other uses, e.g., by salesmen who will display their brochures and other literature by placing them into the pocket 27 whose contents are readily observable through the light-transmitting outer portion 24 of the panel 23. The outer portion 24 is tensioned and remains substantially flat as a result of bonding to the ledges 22. In lieu of, or in addition to bonding, the portions 24, 25 and 26 of the panel 23 can be stitched, stapled and/or otherwise mechanically affixed to the respective ledges.

FIG. 3 shows the construction and mounting of the bottom wall 19 of the section 2. The four sidewalls 5, 14 (not shown in FIG. 3), 30 and 31 of the section 2 have inwardly extending ledges 32 which are bonded, stitched, stapled and/or otherwise affixed to the adjacent edges of the outer portion 34, first inner portion 35 and second inner portion 36 of a flexible light-transmitting panel 33. The portions 34, 35 define a pocket 38 whose open end is shown at 39 and which can be overlapped by or can receive a portion of a flap 37. The latter forms part of the inner portion 36.

The portions 26 and 36 of the respective panels 23, 33 are optional but desirable and advantageous. These panels may but need not be fully transparent (e.g., they may be furnished in suitable eye-pleasing pastel colors as long as at least one of these panels transmits sufficient light to enable a person to see the contents of the respective pocket 27 or 38 without opening the receptacle. Furthermore, the portion 25 and/or 26 may be opaque or may transmit less light than the portion 24, and the same holds true for the portion 35 and/or 36.

The frames including the sidewalls of the sections 1 and 2 can be made of an opaque synthetic plastic material. By properly selecting the color or hue of such opaque material, the manufacturer of the receptacle can enhance its appearance and sales appeal.

The portion 26 and/or 36 of the panel 23 and/or 33 can be omitted. Furthermore, the flap 29 and/or 37 can be omitted, i.e., the bottom wall 18 and/or 19 can have a pair of pockets.

Figure 6:
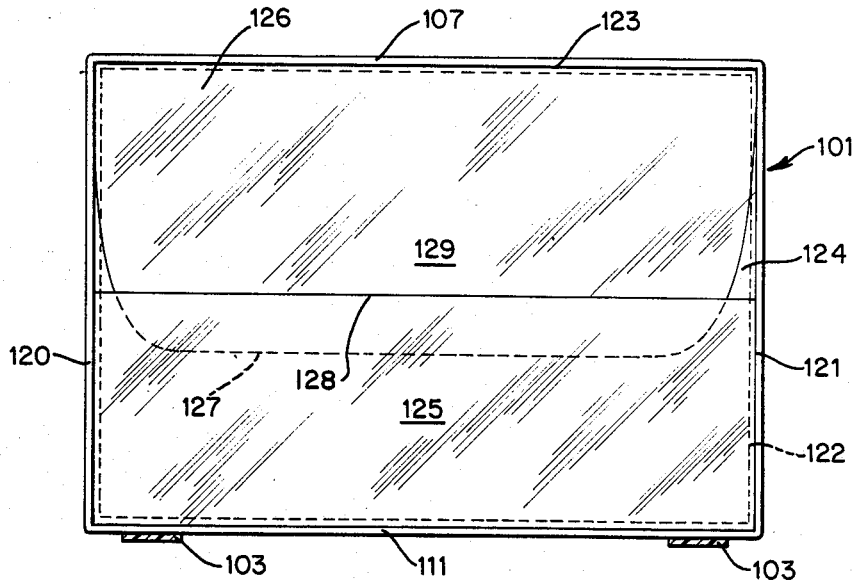
FIG. 6 is a plan view of a section in a modified receptacle wherein the open end of the pocket extends between the two shorter edges of the outer portion of the panel.

FIG. 6 shows one section 101 of a modified receptacle. The frame of this section includes four sidewalls 107, 120, 121, 111 having ledges 122 for the edges of the portions 124, 125, 126 of a modified light-transmitting panel 123 constituting the bottom wall of the section 101. The open end 128 of the pocket 127 between the portions 124 and 125 extends between the two shorter edges of the portion 124, and the flexible flap 129 of the second inner portion 126 can extend into the pocket 127 (as shown) or it can overlie the open end 128.

The other section of the receptacle including the section 101 of FIG. 6 can have a panel 23 or 33 or a panel which is similar to or identical with the panel 123.

The reference characters 103 denote two rudimentary hinges which connect the section 101 to the other section.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A receptacle, particularly a suitcase-like receptacle, comprising a pair of tray-shaped sections each including a bottom wall having marginal portions and a plurality of sidewalls extending from said marginal portions and beyond one side of the bottom wall, at least one of said bottom walls transmitting light and including a one-piece panel having an outer portion and two inner portions, said outer portion and one of said inner portions defining a pocket at the one side of the respective bottom wall and the other of said inner portions including a pivotable flap for said pocket; and at least one hinge connecting one sidewall of one of said sections with one sidewall of the other of said sections.

2. The receptacle of claim 1, wherein the entire panel is flexible.

3. The receptacle of claim 1, wherein the marginal portions of said bottom walls are bonded to the respective sidewalls.

4. The receptacle of claim 1, wherein each of said bottom walls has a light-transmitting panel with a pocket.

5. The receptacle of claim 1, wherein said hinge includes a first leaf secured to one sidewall of one of said sections, a second leaf secured to one sidewall of the other of said sections, and a flexible intermediate portion disposed between and integral with said leaves.

6. The receptacle of claim 1, wherein said sections are substantially mirror symmetrical to each other and are pivotable about an axis which is defined by said hinge to and from closed positions in which said bottom walls are substantially parallel to each other.

7. The receptacle of claim 1, wherein at least some of said sidewalls consist of an opaque material.

8. The receptacle of claim 1, wherein said outer portion is rectangular and said pocket has an open end extending between the two shorter edges of said outer portion.

9. A receptable, particularly a suitcase-like receptacle, comprising a pair of tray-shaped sections each including a bottom wall having marginal portions and a plurality of sidewalls extending from said marginal portions and beyond one side of the bottom wall, at least one of said bottom walls transmitting light and including a panel having a rectangular outer portion, a first inner portion defining with said outer portion a pocket having an open end, and an at least partially flexible second inner portion which overlies the open end of said pocket, said inner portions extending toward each other from opposite longitudinal ends of said outer portion; and at least one hinge connecting one sidewall of one of said sections with one sidewall of the other of said sections.

10. A receptacle, particularly a suitcase-like receptacle, comprising a pair of tray-shaped sections each including a bottom wall having marginal portions and a plurality of sidewalls extending from said marginal portions beyond one side of the bottom wall and defining a plurality of corners, at least one of said bottom walls including a panel having an outer portion and at least one inner portion, said portions defining a pocket at the one side of the respective bottom wall; and a one-piece hinge connecting one sidewall of one of said sections with one sidewall of the other of said sections, said hinge including a first leaf secured to the one sidewall of said one section, a second leaf connected to the one sidewall of said other section, a flexible intermediate portion disposed between said leaves, and at least one reinforcing element for at least one corner of at least one of said tray-shaped sections.

11. The receptacle of claim 10, wherein said pocket has an open end and said panel further includes an at least partially flexible second inner portion which overlies the open end of said pocket.

12. The receptacle of claim 11, wherein said second portion includes a flexible flap which is insertable into said pocket.

13. The receptacle of claim 11, wherein said outer portion is rectangular and said inner portions extend toward each other from opposite longitudinal ends of said outer portion.

14. The receptacle of claim 10, wherein said hinge further comprises at least one additional reinforcing element which contacts the floor or another support when the receptacle is deposited on the support in such orientation that said sections are disposed above said leaves.

15. The receptacle of claim 10, wherein said reinforcing element overlies parts of the marginal portions of both sections.

* * * * *